US009403360B2

(12) United States Patent
Ohnishi

(10) Patent No.: US 9,403,360 B2
(45) Date of Patent: Aug. 2, 2016

(54) PRINT DEVICE AND PRINT METHOD

(71) Applicant: MIMAKI ENGINEERING CO., LTD., Nagano (JP)

(72) Inventor: Masaru Ohnishi, Nagano (JP)

(73) Assignee: MIMAKI ENGINEERING CO., LTD., Nagano (JP)

( * ) Notice: Subject to any disclaimer, the term of this patent is extended or adjusted under 35 U.S.C. 154(b) by 0 days.

(21) Appl. No.: 14/639,132

(22) Filed: Mar. 5, 2015

(65) Prior Publication Data

US 2015/0251423 A1 Sep. 10, 2015

(30) Foreign Application Priority Data

Mar. 6, 2014 (JP) ..... 2014-044264

(51) Int. Cl.
*B41J 2/14* (2006.01)
*B41J 2/045* (2006.01)

(52) U.S. Cl.
CPC ..... *B41J 2/04581* (2013.01); *B41J 2/04593* (2013.01); *B41J 2/14201* (2013.01); *B41J 2/14233* (2013.01)

(58) Field of Classification Search
CPC . B41J 2/14233; B41J 2/14201; B41J 2/14274
See application file for complete search history.

(56) References Cited

U.S. PATENT DOCUMENTS 4,383,264 A * 5/1983 Lewis ..... B41J 2/14201 347/47
2006/0092207 A1 * 5/2006 Shamoun ..... B41J 2/04541 347/14

* cited by examiner

*Primary Examiner* — Geoffrey Mruk
(74) *Attorney, Agent, or Firm* — Jianq Chyun IP Office

(57) ABSTRACT

A print device for performing print using an ink jet method includes an ink jet head for discharging ink droplets, and a drive signal output section for outputting a drive signal for allowing the ink jet head to discharge ink droplets. The ink jet heads includes a nozzle for discharging ink droplets, an ink chamber for storing ink to be supplied to the nozzle at a former stage of the nozzle, the ink chamber having a hole connected to the nozzle on any surface of the ink chamber and an opening on a position different from the hole, a thin film for covering the opening of the ink chamber, and a piezoelectric element that is displaced according to the drive signal so as to apply pressure to the ink chamber. The piezoelectric element is disposed on the thin film with a main surface along the thin film.

7 Claims, 6 Drawing Sheets

PRINT DEVICE AND PRINT METHOD

CROSS REFERENCE TO RELATED APPLICATIONS

This application claims the priority benefit of Japan application serial no. 2014-044264, filed on Mar. 6, 2014. The entirety of the above-mentioned patent application is hereby incorporated by reference herein and made a part of this specification.

TECHNICAL FIELD

The present disclosure relates to a print device and a print method.

DESCRIPTION OF THE BACKGROUND ART

Conventionally, ink jet printers employing an ink jet method are widely used (for example, internet URL http://www.mimaki.co.jp.). In the ink jet printer, ink droplets are discharged from nozzles of ink jet heads so that printing is performed. Further, a driving element for discharging ink droplets from each nozzle is provided on each position of each nozzle in the ink jet head. For example, a piezoelectric element is widely used as such a driving element.

SUMMARY

In recent years, it is desired according to heightening of demanded print quality to discharge ink droplets from nozzles with higher accuracy. For this reason, conventionally, for example, a constitution where ink droplets are discharged from the nozzles more stably is desired. It is, therefore, the present disclosure to provide a print device and a print method that can solve the above problem.

In the ink jet printer, in recent years, it is desired to discharge small droplets of small capacity in order to perform more precise printing. Further, when printing is performed by an ink jet method, ink discharged from the nozzles is influenced by air resistance until it reaches media. When the capacity of ink droplets is small, they are easily influenced by the air resistance.

Further, it is considered that the influence of the air resistance becomes larger as a discharge speed (initial speed) of the ink droplets is lower. For this reason, when ink droplets of small capacity are discharged, in order to reduce the influence of the air resistance, it is desired that the discharge speed of ink droplets is sufficiently heightened. Therefore, a more concrete example of a constitution in which ink droplets from nozzles can be discharged more stably is a constitution in which the discharge speed can be sufficiently heightened even when the capacity of ink droplets is small.

In order to solve the above problem, the present disclosure has the following constitution.

(Constitution 1) A print device for performing printing using an ink jet method includes an ink jet head for discharging ink droplets, and a drive signal output section for outputting a drive signal for allowing the ink jet head to discharge ink droplets. The ink jet head includes a nozzle for discharging ink droplets, an ink chamber for storing ink to be supplied to the nozzle at a former stage of the nozzle which has a hole connected to the nozzle on any surface thereof and an opening on a position different from the hole, an opening section thin film that is a thin film for covering the opening of the ink chamber, and a piezoelectric element for applying pressure to the ink chamber through displacement according to the drive signal, and the piezoelectric element is disposed on the opening section thin film with a main surface of the element along the opening section thin film.

In such a constitution, the piezoelectric element is displaced according to the drive signal so as to, for example, curve on the opening section thin film. With this displacement, pressure is applied to the ink chamber via the opening section thin film. In this case, when the piezoelectric element is disposed so that its main surface overlaps with the opening of the ink chamber, it can make contact with the opening section thin film on a wider area than a case where it is disposed vertically with respect to the ink chamber. Further, for example, it is considered that the piezoelectric element is displaced into a shape of the ink chamber. For this reason, such a constitution enables the pressure to be stably applied to the ink chamber due to the piezoelectric element. As a result, ink droplets can be discharged from the nozzle more stably.

The main surface of the piezoelectric element is the widest surface on the piezoelectric element. Further, arranging the piezoelectric element vertically is arranging the piezoelectric element so that the piezoelectric element elongates and contracts in a direction vertical to the opening section thin film like the arrangement of the piezoelectric element in conventional ink jet heads.

In the ink chamber, the hole connected to the nozzle is formed on, for example, a bottom surface of a cavity composing the ink chamber. Further, the opening of the ink chamber is formed on a surface opposed to the bottom surface.

(Constitution 2) The piezoelectric element curves with its center portion towards the nozzle according to a change in the drive signal, the pressure is applied to the ink chamber via the opening section thin film, and ink droplets are discharged from the nozzle according to the pressure applied to the ink chamber by the piezoelectric element. In such a constitution, ink droplets can be suitably discharged from the nozzle.

(Constitution 3) The piezoelectric element has an electrode that receives the drive signal on one end and the other end in a direction along a surface of the opening section thin film. The direction along a surface of the opening section thin film is a direction perpendicular to a discharge direction of ink droplets from the nozzle. Such a constitution enables the piezoelectric element to be suitably displaced.

(Constitution 4) When inner volume of the ink chamber is set to V0 and capacity of single discharge of ink droplets from the nozzle is set to V1, V1/V0 is 0.5 or more. In this case, ink droplets with capacity of 50% or more in the inner volume of the ink chamber are discharged from the nozzle. The proportion V1/V0 between the inner volume of the ink chamber and the capacity of the ink droplets is preferably 0.9 (90%) or more. Further, it is preferable that the proportion V1/V0 is approximately 1.0 (100%).

In the constitution of the conventional ink jet head, ink droplets are discharged by, for example, separating partial ink from meniscus formed on the position of the nozzle. More concretely, in the conventional constitution, for example, the piezoelectric element is displaced to a direction where ink is pushed out from the nozzle and then to a direction where the ink is pulled back into the nozzle according to a change in the drive signal (push-pull method). As a result, partial ink pushed out from the nozzle is separated from the meniscus, and the separated ink droplets are allowed to fly toward a medium being subject to print.

In this case, since only a part of the ink in the ink chamber is discharged from the nozzle, the proportion V1/V0 between the inner volume of the ink chamber and the capacity of the ink droplets is normally 0.01 (1%) or less. When ink droplets are discharged in this method, a size of the ink droplets is determined according to the balance of a plurality of forces such as a force for pushing out ink from the nozzle and a force for pulling back the ink into the nozzle. For this reason, it is difficult to uniform the size of ink droplets with high accuracy, and thus the capacity of ink droplets (size) might easily vary.

When ink droplets are discharged by the above method and the force for pushing out the ink from the nozzle is made to be too strong, the ink droplets become larger simultaneously with a rise in the speed of the ink droplets. For this reason, it is occasionally difficult to make the force for pushing out the ink from the nozzle strong with the size of the ink droplets being small. As a result, when ink droplets of small capacity are discharged, it is occasionally difficult to heighten the discharge speed of the ink droplets.

On the contrary, in the constitution 4 where the most part of ink in the ink chamber is discharged as ink droplets, the capacity of the ink droplets varies less occasionally than the case where the ink of only little part (for example, 1% or less) of the inner volume of the ink chamber is discharged. Further, in order to discharge the most part of ink in the ink chamber as ink droplets, not the above push-pull method but a constitution where the ink is pushed out directly by the displacement of the piezoelectric element is considered to be used. In this case, the balance of the ink pushing force and pulling force does not have to be taken into consideration. For this reason, the capacity of ink droplets hardly varies also from this point.

In this case, the constitution where the most part of ink in the ink chamber is discharged as ink droplets enables the ink pushing force to be sufficiently strong even when the capacity of the ink droplets is small. For this reason, such a constitution enables ink droplets of small capacity to be discharged suitably at a sufficient discharge speed. As a result, high-definition printing can be performed suitably.

In this case, the constitution where the most part of ink in the ink chamber is discharged enables use of the ink chamber whose inner volume is as small as the capacity of ink droplets. For this reason, the ink chamber of small depth can be used. As a result, when the ink chamber is formed by etching, for example, the ink chamber can be manufactured more easily with high accuracy.

(Constitution 5) The piezoelectric element is displaced into the shape along the surface on which the hole connected to the nozzle is formed in the ink chamber so as to allow the nozzle to discharge ink droplets. Such a constitution enables the most part of ink in the ink chamber to be suitably discharged when ink droplets are discharged from the nozzle.

The displacement of the piezoelectric element into the shape along the surface formed with the hole connected to the nozzle (nozzle formed surface) means the displacement of the piezoelectric element that pushes the most part of ink in the ink chamber to the nozzle. The most part of ink in the ink chamber is, for example, ink that is 50% or more, preferably 90% or more, and more preferably approximately 100% of the inner volume of the ink chamber. Further, the displacement of the piezoelectric element into the shape along the nozzle foil ied surface may mean that the piezoelectric element are displaced so that the opening section thin film and the nozzle formed surface contact or approximately contact with each other.

(Constitution 6) The opening of the ink chamber is formed on a surface that is opposed to the nozzle formed surface on which the hole connected to the nozzle is formed in the ink chamber, and when the nozzle is made to discharge ink droplets, the piezoelectric element is displaced so that at least a part of the opening section thin film contacts with at least a part of the nozzle formed surface in the ink chamber. Such a constitution enables the most part of ink in the ink chamber to be suitably discharged when ink droplets are discharged from the nozzle.

It is preferable that the nozzle formed surface in the ink chamber is formed into a shape according to the displacement of the piezoelectric element (deflection of the piezoelectric element). For example, it is considered that the nozzle formed surface of the ink chamber has a shape where its depth gradually increases toward the center portion in a direction where one end and the other end of the piezoelectric element formed with the electrode are connected. Such a constitution enables the opening section thin film and the nozzle formed surface to contact with each other more suitably.

Further, for example, the portion that contacts with the opening section thin film is considered to be formed flat on the nozzle formed surface of the ink chamber. It is considered that particularly a peripheral portion of the hole connected to the nozzle on the portion that contacts with the opening section thin film is formed into a flat shape. The portion that contacts with the nozzle formed surface on the opening section thin film may be formed into a convex shape. Such constitutions enable the opening section thin film and the nozzle formed surface to contact with each other more suitably.

(Constitution 7) An ink storage section for storing ink to be supplied to the ink chamber, and an ink supply route for supplying the ink from the ink storage section to the ink chamber are further provided, and, the piezoelectric element performs first displacement so that its center portion is curved toward a direction opposite to the nozzle according to a change in the drive signal, then performs second displacement so that the center portion is curved towards the direction of the nozzle, ink is supplied from the ink storage section to the ink chamber via the ink supply route according to the first displacement of the piezoelectric element, and ink droplets are discharged from the nozzle according to the second displacement of the piezoelectric element. The ink storage section is an ink cartridge or an ink tank.

Such a constitution enables the ink to be suitably charged into the ink chamber according to the first displacement of the piezoelectric element before the ink droplets are discharged from the nozzle. Thereafter, the ink in the ink chamber can be suitably pushed out to the nozzle according to the second displacement of the piezoelectric element. As a result, the discharge of the ink droplets from the nozzle can be suitably performed.

In this constitution, it is preferable that the piezoelectric element allows the most part of ink in the ink chamber to be discharged from the nozzle according to the second displacement. In this case, a displacement magnitude of the first displacement is controlled so that the capacity of the ink to be introduced into the ink chamber can be suitably controlled before the discharge. Further, in this case, the inner volume in the ink chamber in the state that the piezoelectric element performs the first displacement can be considered as inner volume V0 in the ink chamber. Such a constitution enables a discharge quantity of ink droplets to be controlled suitably with high accuracy. As a result, high-definition printing can be suitably performed.

(Constitution 8) The print device changes the capacity of the ink droplets to be discharged from the nozzle at plural stages so as to perform multi-gradation printing, and the drive signal output section can output plural kinds of drive signals for making the displacement magnitude in the first displacement vary, and selects a drive signal to be supplied to the piezoelectric element for discharging the ink droplets to the nozzle according to the capacity of the ink droplets to be discharged from the nozzle. In this case, the piezoelectric element allows ink droplets of various capacities to be discharged from the nozzle according to any one of the plural kinds of drive signals to be supplied.

In such a constitution, different kinds of drive signals for making the displacement magnitude in the first displacement vary are used so that the capacity of the ink droplets to be discharged from the nozzle can be varied according to the drive signals. As a result, the size of dots of ink to be formed on a medium through the nozzle can be varied at plural stages. For this reason, such a constitution enables the multi-gradation printing to be suitably performed.

In this case, as to the displacement magnitude of the piezoelectric element in the second displacement, the displacement magnitude is preferably such that most of the ink in the ink chamber after the first displacement is discharged from the nozzle. Such a constitution enables the capacity of the ink droplets to be discharged according to the respective drive signals to be suitably controlled with high accuracy.

The ink jet head may have a plurality of nozzles. In this case, the ink jet head has the ink chambers, the opening section thin films and the piezoelectric elements corresponding to the plurality of nozzles. The drive signal output section selects drive signals to be supplied to the nozzles according to the dot size of ink to be formed by the nozzles. Further, the selected drive signals are supplied to the nozzles, respectively.

(Constitution 9) A print method for performing printing using an ink jet method includes a step of outputting a drive signal for discharging ink droplets to an ink jet head for discharging ink droplets to the ink jet head, and the ink jet head has a nozzle for discharging ink droplets, an ink chamber having a hole connected to the nozzle on any surface and an opening on a position different from the hole which stores ink to be supplied to the nozzle at a former stage of the nozzle, an opening section thin film for covering the opening of the ink chamber, and a piezoelectric element for applying pressure to the ink chamber through displacement according to the drive signal, and the piezoelectric element is disposed on the opening section thin film so that a main surface of the element is along the opening section thin film. Such a constitution can produce the same effect as the constitution 1.

According to the present disclosure, when printing is performed by using the ink jet method, for example, ink droplets can be discharged from the nozzle more stably.

BRIEF DESCRIPTION OF THE DRAWINGS

FIG. 1A illustrates one example of a constitution of a main section of the print device 10; FIG. 1B illustrates one example of a constitution of an ink jet head 12 in the print device 10;

FIG. 2A is a top view illustrating one example of the constitution around the nozzle 102; FIG. 2B is a cross-sectional view illustrating one example of the constitution around the nozzle 102;

FIG. 3A illustrates a state that a piezoelectric element 106 is not displaced due to a drive signal; FIG. 3B illustrates one example of a state that the piezoelectric element 106 is curved according to the drive signal; FIG. 3C illustrates one example of a state of respective sections in the ink jet head 12 at timing when the piezoelectric element 106 is curved;

FIG. 4A illustrates one example of a state of a cross section that the piezoelectric element 106 is curved in the first displacement; FIG. 4B illustrates one example of a state of the respective sections of the ink jet head 12 at timing when the piezoelectric element 106 is curved in the first displacement of the piezoelectric element 106;

FIG. 5A illustrates one example of an operation for varying the capacity of the ink droplets at the plural stages; FIG. 5B illustrates one example of ink droplets 202*s*, 202*m* and 202*l* with plural kinds of capacities;

FIG. 6A illustrates a first modified example of the constitution of the ink jet head 12; and FIG. 6B illustrates a second modified example of the constitution of the ink jet head 12.

DETAILED DESCRIPTION OF PREFERRED EMBODIMENTS

Figure 1A:
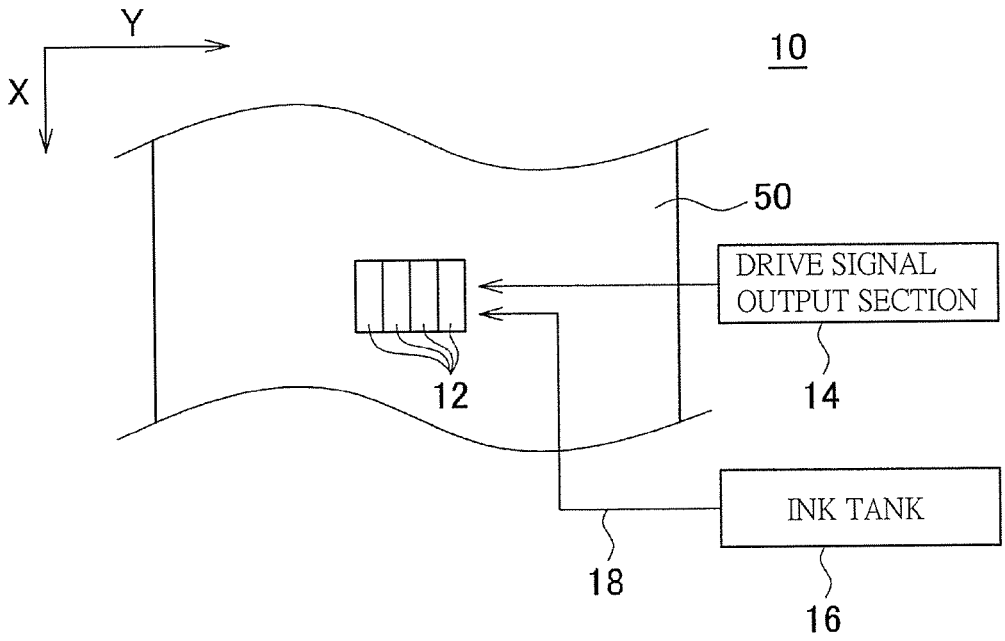
FIGS. 1A and 1B are diagrams illustrating one example of a print device 10 according to one embodiment of the present disclosure.
Figure 1B:
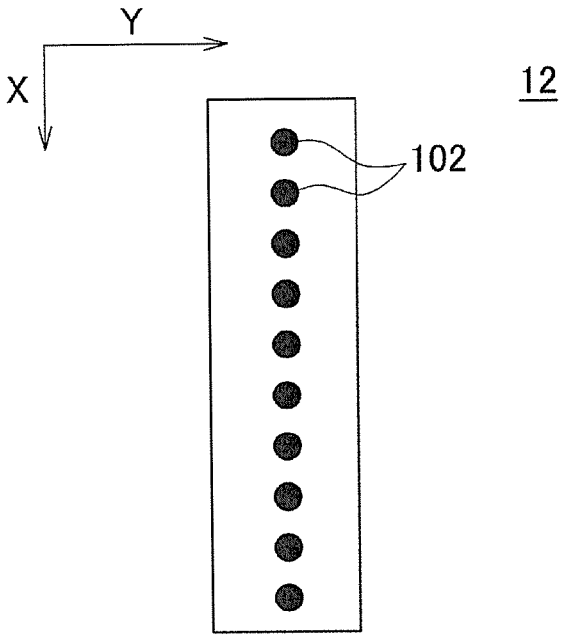

An embodiment of the present disclosure is described below with reference to the drawings. FIGS. 1A and 1B illustrate one example of a print device 10 according to one embodiment of the present disclosure. FIG. 1A illustrates one example of a constitution of a main section of the print device 10. FIG. 1B illustrates one example of a constitution of an ink jet head 12 in the print device 10.

In this example, the print device 10 is an ink jet printer that performs printing using an ink jet method on a medium 50, and it has a plurality of ink jet heads 12, a drive signal output section 14, an ink tank 16, and an ink supply route 18. The plurality of ink jet heads 12 is ink jet heads that discharge ink droplets of different colors, respectively. The plurality of ink jet heads 12 may be ink jet heads for ink of CMYK colors, respectively, for example.

The plurality of ink jet heads 12 performs a main scanning operation for discharging ink droplets while moving to a preset main scanning direction (a direction Y in the drawings) so as to discharge ink droplets onto the medium 50. A sub scanning operation during which the ink jet heads 12 moves to a sub scanning direction (a direction X in the drawing) perpendicular to the main scanning direction relatively with respect to the medium 50 is performed between an interval of the main scanning operations, so that a region of the medium 50 where the main scanning operation is performed is sequentially changed. With these operations, the plurality of ink jet heads 12 performs printing on respective positions on the medium 50.

In this example, each of the ink jet heads 12 has, as shown in FIG. 1B, a plurality of nozzles 102 arranged in the sub scanning direction. Each of the ink jet heads 12 discharges ink droplets through the nozzles according to a drive signal received from the drive signal output section 14.

Not shown in FIGS. 1A and 1B, but the ink jet head 12 further has a constitution for discharging ink droplets from nozzles 102. FIGS. 1A and 1B, for convenience of the description, illustrate an example of a constitution where only one nozzle row of the plurality of nozzles 102 is arranged in the sub scanning direction. However, when a speed and resolution are improved, a plurality of nozzle rows may be provided. Further, more concrete constitution and operation of the ink jet head 12 are described in detail later.

The drive signal output section 14 is a signal output section for outputting drive signals for allowing the plurality of ink jet heads 12 to discharge ink droplets. The drive signal output section 14 outputs drive signals to the nozzles 102 in each of the ink jet heads 12, respectively, according to an image to be printed. In this example, to output drive signals to the nozzles 102 means outputting the drive signals to piezoelectric elements related to the nozzles 102.

The ink tank 16 is one example of an ink storage section for storing ink to be supplied to the ink chambers in each of the ink jet head 12. In this example, the ink tank 16 is disposed outside the ink jet heads 12, and supplies ink to the ink jet heads 12 via the ink supply route 18. An ink cartridge may be used as the ink storage section, for example. Further, the ink storage section may be disposed inside each of the ink jet heads 12. The ink supply route 18 is, for example, an ink tube, and it connects the ink tank 16 to the respective ink jet heads 12 so that ink is supplied from the ink tank 16 to the respective ink jet heads 12. In this constitution, the print device 10 performs printing using the ink jet method on the medium 50.

Except for the above and following description, the print device 10 may have the constitution the same as or similar to that of the known ink jet printer. The print device 10 may further have various constitutions necessary for printing besides the above constitution. More concretely, the print device 10 may further have a driving section for allowing the plurality of ink jet heads 12 to perform the main scanning operation and the sub scanning operation.

Known various ink can be used as the ink to be used in the ink jet heads 12. For example, UV ink that is cured by irradiation with ultraviolet or solvent UV ink obtained by diluting UV ink with organic solvent can be preferably used. Further, solvent ink or latex ink can be preferably used. The print device 10 may further have a constitution for fixing ink on the medium 50 according to a type of ink to be used. When UV ink or solvent UV ink is used, the print device 10 may further have a UV irradiation device. When ink that should be dried (solvent UV ink, solvent ink, latex ink, or emulsion ink) is used, the print device 10 may further have a heater.

Figure 2A:
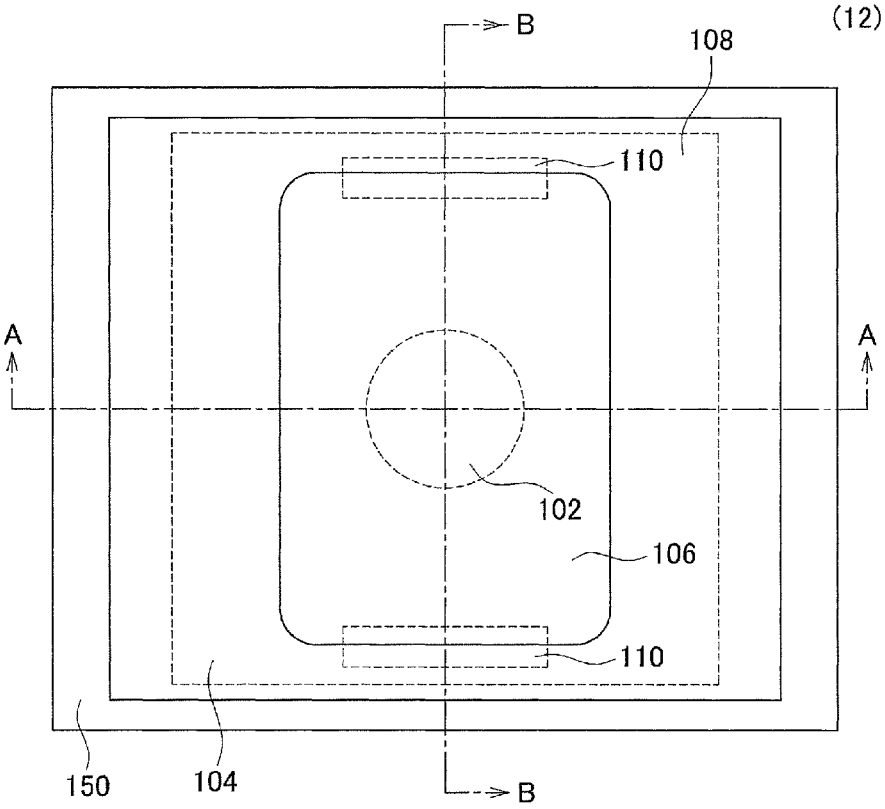
FIGS. 2A and 2B are diagram illustrating a detailed constitution around a nozzle 102 for discharging ink droplets in the ink jet head 12.
Figure 2B:
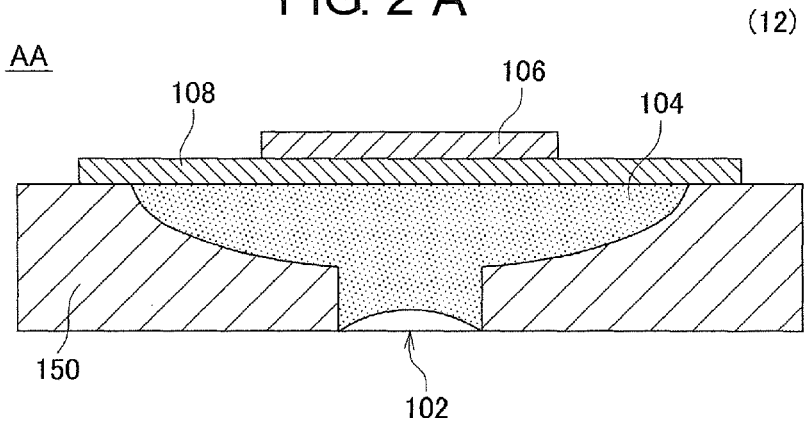

The constitution and the operation of the ink jet heads 12 in this example are described in more detail below. FIGS. 2A and 2B illustrate the more detailed constitution of a periphery of the nozzle 102 for discharging ink droplets in the ink jet head 12. FIG. 2A is a top view illustrating one example of the constitution around the nozzle 102 in a case where an internal constitution of the ink jet head 12 is viewed from a side opposite to a nozzle surface formed with the nozzle 102. FIG. 2B is a cross-sectional view illustrating one example of the constitution around the nozzle 102 taken along alternate long and short dash line AA shown in FIG. 2A.

As shown in FIG. 1B, in this example, the ink jet head 12 has the plurality of nozzles 102 that is arranged in the sub scanning direction. The plurality of nozzles 102 is formed on a nozzle plate 150. The ink jet head 12 further has the ink chamber 104, a thin film 108, and a piezoelectric element 106 on each position of each of the nozzles 102.

The nozzle plate 150 is a plate-shaped body formed with the hole-shaped nozzles 102 and cavity sections connected to the nozzles 102, respectively. The nozzle plate 150 may be a common member with respect to the plurality of nozzles 102. In this case, the nozzle plate 150 is integrally constituted so that the plurality of nozzles 102 and the plurality of cavity sections are formed on one plate-shaped body. The nozzle plate 150 may be composed of, for example, a plurality of members. A liquid repellent layer (water repellent layer) may be formed on the surface of the nozzle plate.

In this example, the cavity sections of the nozzle plate 150 are covered with the thin film 108 so as to function as the ink chambers 104. In this case, the ink chambers 104 mean regions where ink to be supplied to the nozzles 102 is stored at a former stage of the nozzles 102. Each hole which is connected to each of the nozzle 102 is formed on a surface of the ink jet head 12 opposed to the medium 50 in each of ink chambers 104. Each of the ink chambers 104 has an opening that is covered with each of the thin films 108 on a position different from each of the holes. More concretely, in the ink chamber 104, the hole connected to the nozzle 102 is formed on a bottom surface of the cavity composing the ink chamber 104. As a result, the bottom surface of the ink chamber 104 becomes a nozzle formed surface that is a surface formed with the hole connected to the nozzle 102. The opening of the ink chamber 104 is formed on a surface opposed to the bottom surface. As a result, the ink chamber 104 stores the ink to be discharged from the nozzle 102 in a position adjacent to the nozzle 102.

The thin film 108 is one example of an opening section thin film that is a thin film covering the opening of the ink chamber 104. A flexible thin film that deforms according to displacement of the piezoelectric element 106 can be preferably used as the thin film 108. The thin film 108 is a film that covers the cavity section on the nozzle plate 150 from an opposite side of the nozzle 102. When the cavity section is covered, the ink chamber 104 is formed between the nozzle and the bottom surface of the cavity section.

The piezoelectric element 106 is a driving element for discharging ink droplets from the nozzle 102. The piezoelectric element 106 is displaced according to a drive signal supplied from the drive signal output section 14 (see FIGS. 1A and 1B), so as to press the thin film 108 and apply pressure to the ink chamber 104. As a result, the piezoelectric element 106 pushes a constant amount of ink in the ink chamber 104 out so as to discharge ink droplets from the nozzle 102.

Further, in this example, the piezoelectric element 106 is a thin film type piezoelectric element that is disposed on the thin film 108 with its main surface along the thin film 108. In this case, the main surface of the piezoelectric element 106 means, for example, the widest surface on the piezoelectric element 106. Further, the main surface of the piezoelectric element 106 may be a main surface of the thin film composing the piezoelectric element.

More concretely, the piezoelectric element 106 is disposed so that the main surface overlaps with the opening of the ink chamber 104 and the discharge direction of ink droplets from the nozzle 102 is perpendicular to the main surface. The state that the main surface of the piezoelectric element 106 is perpendicular to the discharge direction of the ink droplets may mean a state that they are practically perpendicular to each other according to manufacturing accuracy of the components of the ink jet heads 12 with the piezoelectric element 106 not being displaced. More concretely, to be practically perpendicular may mean being perpendicular on the arrangement of design.

Further, in this example, the piezoelectric element 106 has an electrode 110 that receives a drive signal on one end and the other end in a direction along the surface of the thin film 108. The direction along the surface of the thin film 108 means the direction perpendicular to the discharge direction of ink droplets from the nozzle 102.

In such a constitution, the piezoelectric element 106 is displaced so as to be curved on the thin film 108 according to a drive signal. As a result of this displacement, pressure is applied to the ink chamber 104 via the thin film 108. For this reason, in this example, the pressure can be applied to the ink chamber 104 stably and suitably. In this example, the displacement of the piezoelectric element 106 is controlled by a drive signal so that a constant amount of ink droplets can be suitably discharged from the nozzle 102.

A known thin piezoelectric element can be preferably used as the piezoelectric element 106. In this case, the piezoelectric element 106 is stuck on the thin film 108 so as to be disposed as described above. Further, the piezoelectric element 106 may be covered with coating resin on the thin film 108. Such a constitution enables the piezoelectric element 106 to be disposed stably on the thin film 108. It is also considered that by carrying out deposition or sputtering on the thin film 108 at a step of manufacturing the ink jet head 12, the piezoelectric element 106 is formed on the thin film 108. Such a constitution enables the piezoelectric element 106 to be disposed on a desired position with higher accuracy.

The electrode 110 of the piezoelectric element 106 may be disposed on one end and the other end of the piezoelectric element 106 in the direction along the surface of the thin film 108 so as to be partially placed on the thin film 108. In this case, it is considered that a portion of the electrode 110 to be placed on the thin film 108 is adhered to the thin film 108. Such a constitution enables the piezoelectric element 106 to be suitably fixed on the thin film 108. Further, the electrode 110 is not disposed separately from the piezoelectric element 106, but may be constituted as a part of the piezoelectric element 106. In this case, it is preferable that the piezoelectric element 106 is formed on the thin film 108 by adhering it on an entire surface.

Not shown in the drawing, but the ink jet heads 12 further has an ink channel (ink supply section) that connects the ink supply route 18 (see FIGS. 1A and 1B) and the ink chamber 104. The ink channel preferably has a position and a structure where it is closed or channel resistance increases at predetermined timing according to the operation of the piezoelectric element 106 at the time of discharge of ink droplets.

The displacement of the piezoelectric element 106 is described in more detail below. As described in more detail below, in this example, the piezoelectric element 106 discharges all the ink in the ink chamber 104 from the nozzle 102 at each discharge of ink droplets.

Figure 3A:
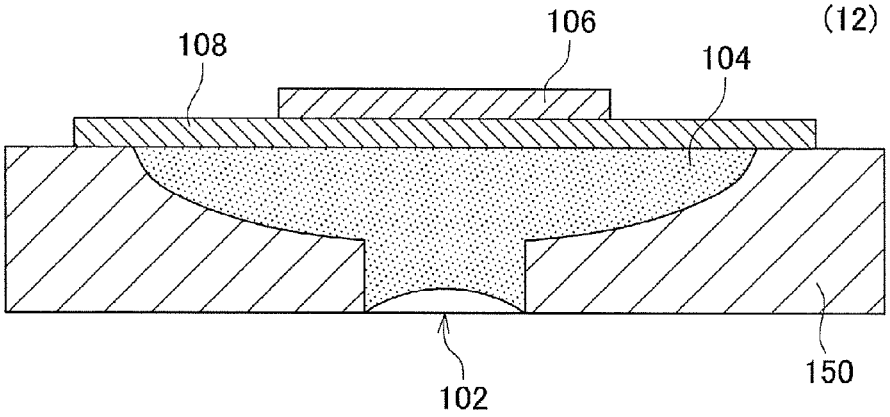
FIGS. 3A to 3C are diagrams illustrating one example of an operation for discharging ink droplets from the nozzle 102.
Figure 3B:
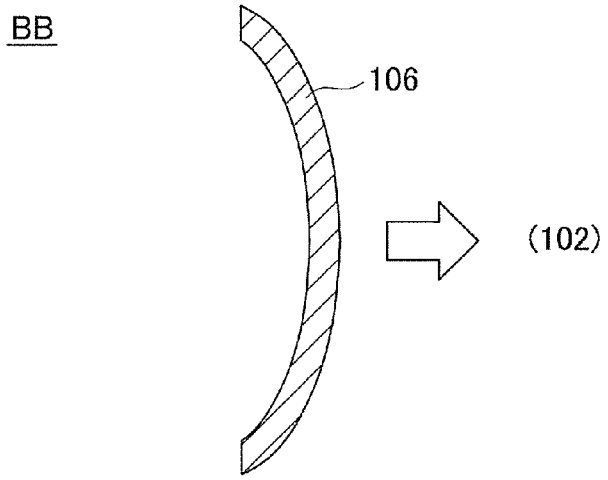
Figure 3C:
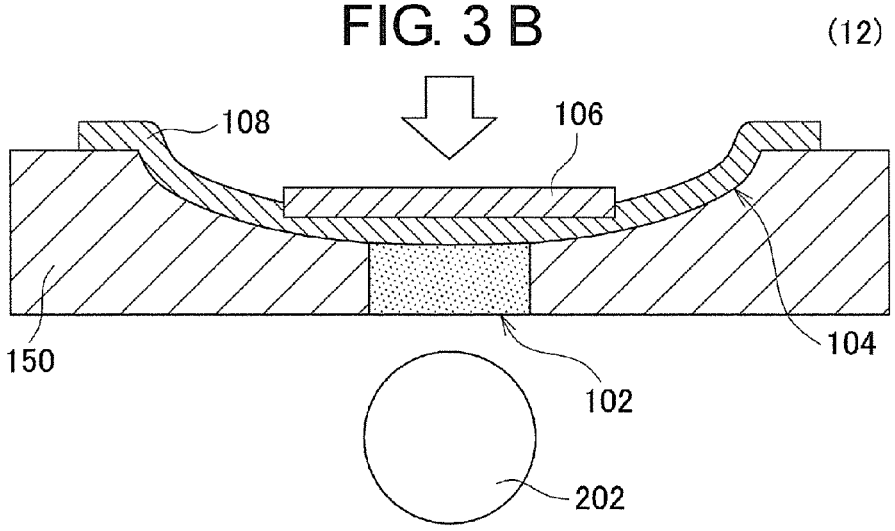

The operation for discharging ink droplets from the nozzle 102 according to the displacement of the piezoelectric element 106 is described in more detail below. FIGS. 3A to 3C illustrate one example of the operation for discharging ink droplets from the nozzle 102. FIG. 3A illustrates a state that a piezoelectric element 106 is not displaced due to a drive signal. In the state that the piezoelectric element 106 is not displaced through a drive signal, the piezoelectric element 106 is not curved, namely, flat. In this case, the ink chamber 104 is charged with a predetermined initial capacity of ink.

FIG. 3B is a diagram illustrating one example of a state that the piezoelectric element 106 is curved according to a drive signal, and illustrates one example of a state of a cross section taken along alternate long and short dash line BB shown in FIG. 2A where the piezoelectric element 106 is curved. In this case, the state of the cross section taken along alternate long and short dash line BB shown in FIG. 2A means a state of a cross section of a portion taken along alternate long and short dash line BB shown in FIG. 2A where the piezoelectric element 106 is curved. FIG. 3C illustrates one example of a state of respective sections in the ink jet head 12 at timing when the piezoelectric element 106 is curved.

In this example, the piezoelectric element 106 is curved with its center portion toward the nozzle 102 according to a change in the drive signal. As a result, the piezoelectric element 106 applies pressure to the ink chamber 104 via the thin film 108. Further, ink droplets 202 are discharged from the nozzle 102 according to the pressure applied to the ink chamber 104 by the piezoelectric element 106. For this reason, the ink droplets 202 can be suitably discharged from the nozzle 102.

Further, in this example, when the ink droplets 202 are discharged from the nozzle 102, the piezoelectric element 106 is displaced so that at least a part of the thin film 108 comes in contact with at least a part of the bottom surface of the ink chamber 104. Such a constitution enables most of the ink in the ink chamber 104 to be suitably discharged at the time of the discharge of the ink droplets 202.

The most of the ink in the ink chamber 104 means ink with 50% or more of an inner volume of the ink chamber 104, preferably 90% or more, and more preferably approximately 100%. More concretely, when the inner volume of the ink chamber 104 is set to V0 and the capacity of single discharge of the ink droplets 202 from the nozzle 102 is set to V1, it is preferable that V1/V0 is 0.5 or more. This corresponds to a case where the capacity of single discharge of the ink droplets 202 from the nozzle is 50% or more of the inner volume in the ink chamber 104. It is preferable that the proportion V1/V0 between the inner volume of the ink chamber 104 and the capacity of the ink droplets 202 is 0.9 (90%) or more. Further, it is preferable that the proportion V1/V0 is approximately 1.0 (100%).

More concretely, the piezoelectric element 106 is displaced so that the entire bottom surface of the ink chamber 104 comes in contact with the thin film 108 at the discharge of ink droplets 202. As a result, the piezoelectric element 106 allows all the ink in the ink chamber 104 to be discharged as the ink droplets 202 from the nozzle 102.

All the ink in the ink chamber 104 may be almost all ink that is practically all the ink. The discharge of practically all the ink in the ink chamber 104 from the nozzle means discharge of all the ink in the ink chamber 104 from the nozzle in design operation. This may be such that all the ink introduced into the ink chamber 104 before the discharge is discharged without intentionally leaving some ink through an operation for pulling back the ink into the nozzle 102 in the design operation.

The contact of the thin film 108 with the entire bottom surface of the ink chamber 104 means, as shown in FIG. 3C, contact of the thin film 108 with the bottom surface of the ink chamber 104 with the thin film 108 covering the entire bottom surface of the ink chamber 104. Further, the entire bottom surface of the ink chamber 104 means, for example, a portion of the bottom surface of the ink chamber 104 other than the hole connected to the nozzle 102.

In the constitution of the conventional ink jet heads, a push-pull system is widely used as the system for discharging ink droplets. In this case, ink droplets are discharged by separating some ink from meniscus of the ink formed on the position of the nozzle.

In this case, however, since only some ink in the ink chamber is discharged from the nozzle, the proportion V1/V0 between the inner volume of the ink chamber and the capacity of ink droplets is normally about 0.01 (1%) or less. When ink droplets are discharged in this method, a size of the ink droplets is determined according to the balance of a plurality of forces such as a force for pushing out ink from the nozzle and a force for pulling the ink back into the nozzle. For this reason, it is difficult to uniform the size of ink droplets with high accuracy, and thus the capacity of ink droplets (size) might easily vary.

In the case where ink droplets are discharged by the push-pull method, for example, when the force for pushing the ink out from the nozzle is made to be too strong, the ink droplets becomes larger simultaneously with a rise in the speed of the ink droplets. For this reason, it is occasionally difficult to make the force for pushing out the ink from the nozzle strong with the size of the ink droplets being small. As a result, when ink droplets of small capacity are discharged, it is occasionally difficult to heighten the discharge speed of the ink droplets.

On the contrary, due to the constitution where the most of the ink in the ink chamber 104 is discharged as the ink droplets 202, the capacity of the ink droplets 202 hardly varies compared to a case where ink whose capacity is only a small part of the inner volume of the ink chamber 104 (for example, about 1% or less) is discharged. In the constitution where the most of the ink in the ink chamber 104 is discharged as the ink droplets 202, the ink can be directly pushed out not by the push-pull method but only by the displacement of the piezoelectric element 106 to the direction where pressure is applied to the ink chamber 104 at the discharge timing. In this case, the balance between the ink pushing-out force and the pulling-back force does not have to be taken into consideration. For this reason, also from this viewpoint, the capacity of the ink droplets 202 does not easily vary.

Further, in the constitution where the most of the ink in the ink chamber 104 is discharged as the ink droplets 202, even when the capacity of the ink droplets 202 is small, the force for pushing out the ink can be sufficiently made to be strong without considering the operation for pulling back the ink into the ink droplets 202. As a result, even when the capacity of the ink droplets is small, ink droplets can be discharged at a sufficient discharge speed (initial speed). For this reason, even when small ink droplets with small capacity are discharged, the discharge speed is sufficiently heightened, and an influence of air resistance on the ink droplets can be reduced. As a result, high-definition printing can be performed more suitably.

In the constitution where the most of the ink in the ink chamber 104 is discharged, when the inner volume of the ink chamber 104 is small, the ink droplets of necessary capacity can be suitably discharged. For this reason, the ink chamber 104 whose depth is small can be used in this example. As a result, when the ink chamber 104 is formed by etching, the ink chamber 104 can be easily manufactured with high accuracy.

More concretely, in this example, the bottom surface of the ink chamber 104 is formed into a shape that matches with the displacement of the piezoelectric element 106. The displacement of the piezoelectric element 106 means deflection of the piezoelectric element 106 when the piezoelectric element 106 is curved according to a drive signal at the time of the discharge of the ink droplets 202. More concretely, it is considered that the bottom surface of the ink chamber 104 has a round shape that accords with a curve amount of the piezoelectric element 106 and the shape where the depth becomes larger toward the center in a direction where one end and the other end on the piezoelectric element 106 that are provided with the electrode are connected. Such a constitution enables the thin film 108 and the bottom surface of the ink chamber 104 to contact with each other more suitably at the time of the discharge of the ink droplets 202. Further, it is considered that the bottom surface has a round shape where the depth becomes larger toward the center also in a direction perpendicular to the direction where the electrodes on the piezoelectric element 106 are connected.

When the bottom surface of the ink chamber 104 has such a shape, the piezoelectric element 106 is displaced into a shape along the bottom surface of the ink chamber 104 at the time of the discharge of the ink droplets 202. As a result, the piezoelectric element 106 discharges the most of the ink in the ink chamber 104 from the nozzle 102.

Further, in this example, the piezoelectric element 106 is disposed so that the main surface overlaps with the opening of the ink chamber 104 via the thin film 108. For this reason, according to this example, the piezoelectric element 106 can be allowed to contact with the thin film 108 on a wide area suitably. As a result, the piezoelectric element 106 can be displaced also into a shape along the shape of the ink chamber 104. For this reason, ink droplets can be discharged more stably also from this viewpoint.

The above has described only the displacement of the piezoelectric element 106 at the timing of discharging the ink droplets 202 for convenience of the description. In the actual print operation, however, it is considered that before the timing of the discharge of the ink droplets 202, the piezoelectric element 106 is displaced to an opposite direction so as to supply a predetermined amount of ink into the ink chamber 104. In this case, the piezoelectric element 106 performs the first displacement such that the center is deformed to the direction opposite to the nozzle 102 according to a change in the drive signal. Thereafter, the second displacement is performed that the center is curved to the direction of the nozzle. In this case, the ink is supplied to the ink chamber 104 from the ink tank 16 via the ink supply route 18 (see FIGS. 1A and 1B) according to the first displacement of the piezoelectric element 106. Ink droplets are discharged from the nozzle 102 according to the second displacement of the piezoelectric element 106. Therefore, such an operation is described in more detail below.

Figure 4A:
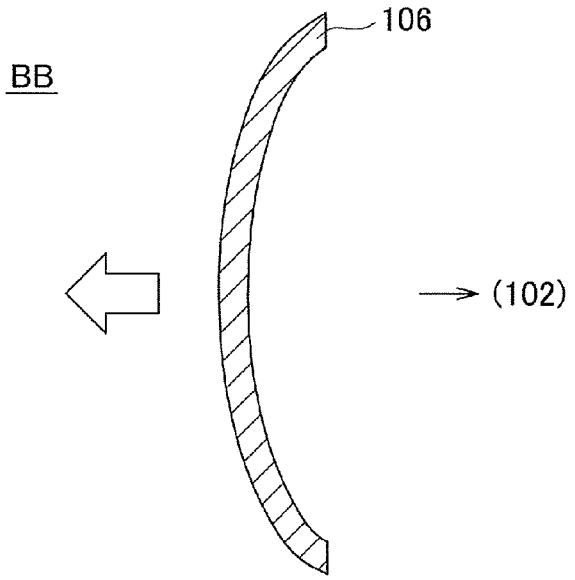
FIGS. 4A and 4B are diagrams describing first displacement that is displacement of the piezoelectric element 106 at timing when ink is supplied to an ink chamber 104.
Figure 4B:
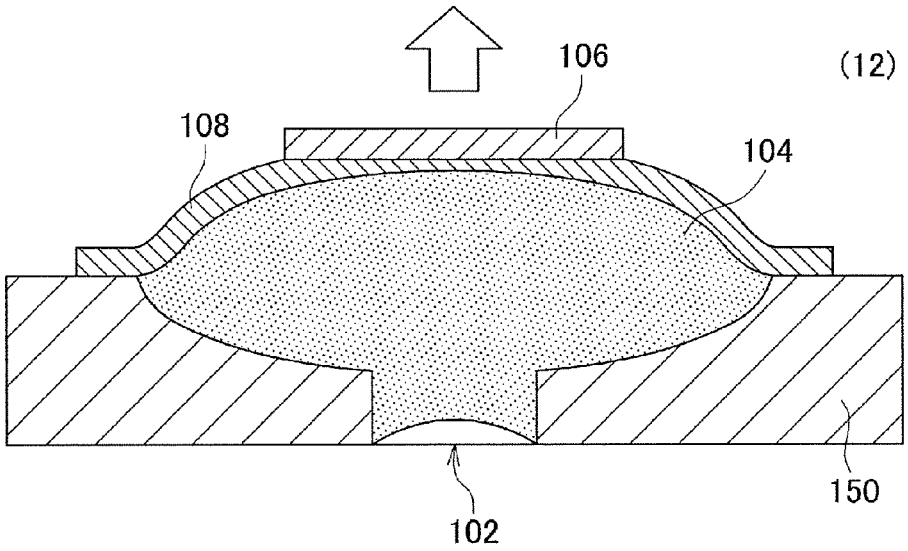

FIGS. 4A and 4B are diagrams describing the first displacement that is displacement of the piezoelectric element 106 at timing when ink is supplied to the ink chamber 104. FIG. 4A illustrates one example of a state of a cross section taken along alternate long and short dash line BB shown in FIG. 2A that the piezoelectric element 106 is curved in the first displacement. FIG. 4B illustrates one example of a state of the respective sections of the ink jet head 12 at the timing when the piezoelectric element 106 is curved in the first displacement of the piezoelectric element 106.

In this example, the piezoelectric element 106 performs the first displacement such that the center is deformed to the direction opposite to the nozzle 102 according to a drive signal. In this case, that the center is curved toward the direction opposite to the nozzle 102 is that the piezoelectric element 106 is curved so that the center of the piezoelectric element 106 is separated from the nozzle 102 as shown in the drawings. As a result, the piezoelectric element 106 pulls up the thin film 108 to a direction separated from the nozzle 102, so as to widen the ink chamber 104. The ink is pulled into the ink chamber 104 according to this operation. For this reason, such a constitution enables the ink chamber 104 to be charged with the ink suitably before the discharge of ink droplets from the nozzle 102.

In this operation, to pull the ink into the ink chamber 104 means pulling the ink into the ink chamber 104 from the ink tank 16 (see FIGS. 1A and 1B) via the ink supply route 18 (see FIGS. 1A and 1B). The ink can be pulled by utilizing ink supply pressure from the ink supply route 18 to the ink chamber 104. In this example, the piezoelectric element 106 performs the first displacement by a preset displacement magnitude according to a drive signal, and the ink of the preset capacity is pulled into the ink chamber 104.

In this case, the first displacement of the piezoelectric element 106 allows the ink to flow into the ink chamber 104, so that the capacity in the ink chamber 104 becomes larger than the initial capacity before the displacement of the piezoelectric element 106. For this reason, when the proportion V1/V0 between the inner volume of the ink chamber 104 and the capacity of the ink droplets 202 is considered, the inner volume of the ink chamber 104 in the state that the piezoelectric element 106 performs the first displacement may be considered as inner volume V0 of the ink chamber 104.

After the first displacement, the piezoelectric element 106 performs the second displacement by which the center is curved toward the direction of the nozzle. The second displacement is the displacement of the piezoelectric element 106 described with reference to FIGS. 3A to 3C. As a result, the piezoelectric element 106 allows most of the ink in the ink chamber 104 to be discharged from the nozzle 102. It is preferable that the piezoelectric element 106 allows all the ink in the ink chamber 104 to be discharged from the nozzle 102.

In this example, the displacement magnitude of the first displacement is controlled, so that the capacity of the ink to be introduced into the ink chamber 104 before the discharge can be suitably controlled. The second displacement of the piezoelectric element 106 to be performed later enables the ink pulled into the ink chamber 104 to be suitably discharged from the nozzle 102. For this reason, the desired capacity of ink droplets can be discharged from the nozzle 102 suitably with high accuracy.

In the constitution of this example, the second displacement of the piezoelectric element 106 enables most of the ink in the ink chamber 104 to be pushed out from the nozzle 102. In this case, ink droplets can be discharged from the nozzle 102 at the discharge speed according to a displacement speed in the second displacement. For this reason, the discharge speed of ink droplets can be suitably controlled into a desired speed with high accuracy by adjusting the displacement speed of the piezoelectric element 106 in the second displacement regardless of the capacity of ink droplets. Therefore, according to this example, printing can be suitably performed with higher accuracy.

In the second displacement of the piezoelectric element 106, it is desirable that the displacement speed is sufficiently heightened in order to sufficiently heighten the discharge speed of ink droplets. On the other hand, in the first displacement of the piezoelectric element 106 that is performed in order to pull ink into the ink chamber 104, it is desirable that the displacement speed is not unnecessarily heightened from viewpoints that ink is suitably pulled into the ink chamber 104 at an inflow velocity according to the supply pressure of ink and unnecessary disturbance that occurs in the ink in the ink chamber 104 is prevented. For this reason, it is considered that the displacement speed of the piezoelectric element 106 in the first displacement is set to be smaller than the displacement speed in the second displacement. In this case, the displacement speed of the piezoelectric element 106 means a progressing amount of the curve of the piezoelectric element 106 per predetermined unit time.

It is considered that a push-pull method is used as a method for adjusting the capacity of ink droplets to desired capacity that is different from the method of this example. As described above, however, when the ink droplets are discharged by the push-pull method, since the size of the ink droplets is determined according to the balance of a plurality of forces such as the force for pushing out ink from the nozzle and a force for pulling back the ink into the nozzle, it is difficult to uniform the size of the ink droplets accurately. Further, when small capacity of ink droplets is discharged, it is difficult to heighten the discharge speed of the ink droplets.

On the contrary, with the constitution of this example where most of the ink in the ink chamber 104 is discharged from the nozzle 102, the constant capacity of the ink droplets 202 can be suitably discharged. For this reason, a variation in the capacity of the ink droplets 202 can be repressed suitably and independently from the speed of the ink droplets. Also when the capacity of the ink droplets is mall, the discharge speed can be suitably heightened.

As described above, it is preferable that all the ink in the ink chamber 104 is discharged from the nozzle 102 in the second displacement of the piezoelectric element 106. Such a constitution enables a constant capacity of ink droplets to be suitably discharged with higher accuracy.

However, when the ink once pushed out of the nozzle 102 is not pulled back into the nozzle 102 and most of the ink in the ink chamber 104 is discharged as ink droplets from the nozzle 102, the same effect can be produced although not all the ink in the ink chamber 104 is discharged. For example, it is considered that ink, which is within a range of 70% or more (for example, 70% to 140%) of the inner volume of the ink chamber 104 in the initial state where the piezoelectric element 106 is not displaced, is discharged from the nozzle 102. The initial state of the piezoelectric element 106 means a state that a voltage is not applied to the piezoelectric element 106. Such a constitution also enables a constant capacity of ink droplets to be suitably discharged regardless of the balance of a plurality of forces such as the force for pushing out ink from the nozzle 102 and the force for pulling back the ink into the nozzle.

Further, as described above, the displacement magnitude of the piezoelectric element 106 to the side opposite to the nozzle 102 is controlled so that the capacity of ink to be introduced into the ink chamber 104 before discharge can be suitably controlled. Thereafter, most of the ink in the ink chamber 104 is discharged from the nozzle 102 so that the desired capacity of ink droplets can be suitably discharged with high accuracy. For this reason, it is considered that the capacity of ink droplets to be discharged from the nozzle 102 is changed at a plurality of stages, and multi-gradation printing is performed in the print device 10 of this example by using this characteristic.

Figure 5A:
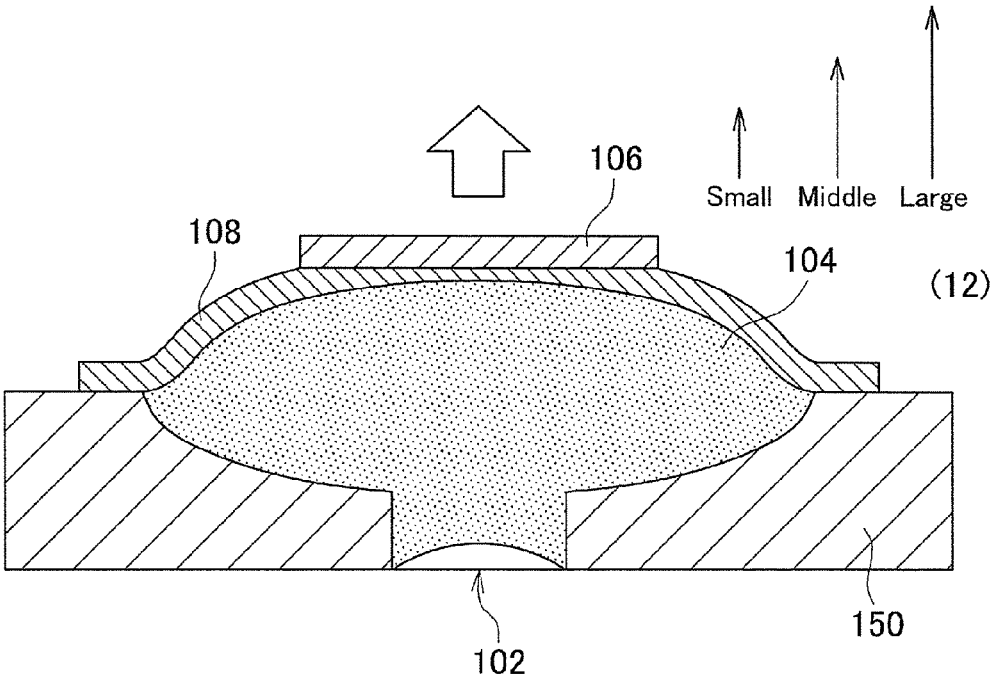
FIGS. 5A and 5B are diagrams describing a case where capacity of the ink droplets is variable at plural stages.
Figure 5B:
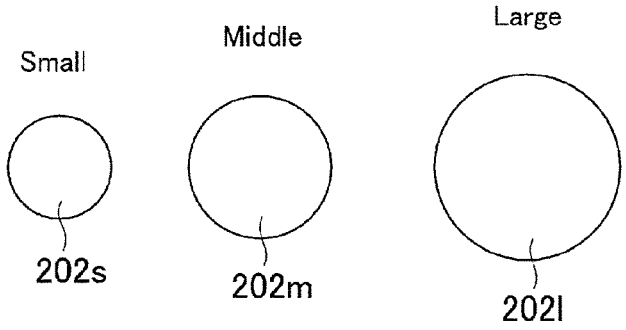

FIGS. 5A and 5B are diagrams describing a case where the capacity of the ink droplets is variable at plural stages. FIG. 5A illustrates one example of an operation for varying the capacity of the ink droplets at the plural stages. FIG. 5B illustrates one example of ink droplets 202*s*, 202*m* and 202*l* with plural kinds of capacities.

When the capacity of ink droplets is variable at plural stages, a constitution in which plural kinds of drive signals for making displacement magnitude in the first displacement different can be output is used as the drive signal output section 14 (see FIGS. 1A and 1B). A drive signal to be supplied to each of the piezoelectric elements 106 for allowing each of the nozzles 102 to discharge ink droplets is selected according to the capacity of ink droplets to be discharged from each of the nozzles 102 in the ink jet head 12.

In this case, the piezoelectric element 106 performs the first displacement by the displacement magnitude according to any drive signal in the plural kinds of drive signals to be supplied. As a result, ink is pulled into the ink chamber 104 according to the displacement magnitude in the first displacement. The second displacement for discharging ink droplets from the nozzle 102 is performed thereafter, so that most of the ink in the ink chamber 104 is discharged from the nozzle 102. In this case, it is preferable that all the ink in the ink chamber 104 is discharged from the nozzle 102.

Such a constitution enables the capacity of ink droplets to be discharged from the nozzle 102 to vary suitably according to the amount of the ink pulled into the ink chamber 104. As a result, various capacities of ink droplets can be discharged from the nozzle 102 according to the plural kinds of drive signals. For this reason, such a constitution enables the multi-gradation printing to be suitably performed.

As to the plural kinds of drive signals, the displacement magnitude of the piezoelectric element 106 in the second displacement may be uniform. The displacement magnitude of the piezoelectric element 106 in the second displacement is displacement magnitude that is compared with the displacement magnitude in the initial state that the piezoelectric element 106 is not displaced.

More concretely, as shown in FIG. 5B, when the capacity of ink droplets is variable at plural stages including three stages of the ink droplets 202*s* with small capacity, the ink droplets 202*m* with middle capacity, and the ink droplets 202*l* with large capacity, the drive signal output section 14 outputs a plurality of drive signals corresponding to the ink droplets 202*s*, 202*m* and 202*l*. When the drive signal corresponding to the ink droplets 202*s* is received at timing before discharge of ink droplets, the piezoelectric element 106 is displaced to the side opposite to the nozzle 102 by small displacement magnitude as an arrow indicated by Small in FIG. 5A in the first displacement.

When the drive signal corresponding to the ink droplets 202*m* is received, the piezoelectric element 106 is displaced to the side opposite to the nozzle 102 by middle displacement magnitude as an arrow indicated by Middle in the first displacement. Further, when the drive signal corresponding to the ink droplets 202*l* is received, the piezoelectric element 106 is displaced to the side opposite to the nozzle 102 by large displacement magnitude as an arrow indicated by Large in the first displacement. Thereafter, the piezoelectric element 106 performs the second displacement for the displacement toward the nozzle 102, so as to discharge the respective capacities of the ink droplets 202*s*, 202*m*, and 202*l* from the nozzle 102.

Such a constitution enables the capacity of ink droplets to be discharged from the nozzle 102 according to the plural kinds of drive signals to vary suitably at plural stages. As a result, ink dots of the plural kinds of sizes can be formed on a medium. Further, in this case, the constitution where most of the ink in the ink chamber 104 is discharged from the nozzle 102 can repress a variation in the capacity of ink droplets suitably. For this reason, such a constitution enables gradation printing using the ink dots of plural kinds of sizes suitably with high accuracy.

It is considered that the push-pull method can be used as the method for making the capacity of ink droplets to be discharged from the nozzle variable at plural stages. In this case, however, the discharge speed of ink droplets might vary according to the variation in the capacity of the ink droplets. As a result, it is considered that an error occurs in a striking position of ink droplets due to the variation in the capacity of the ink droplets. More concretely, like this example, the main scanning operation is performed so that printing is performed, the striking position of ink droplets changes according to the discharge speed of ink droplets. For this reason, when the discharge speed changes according to the ink capacity, it might be difficult to control the striking position with high accuracy.

On the contrary, in the constitution described with reference to FIGS. 5A and 5B, since most of the ink in the ink chamber 104 is discharged from the nozzle 102, as described with reference to FIGS. 3 and 4, the capacity of ink droplets and the discharge speed of ink droplets can be controlled independently. As a result, a variation in the discharge speed of ink droplets that is caused by the variation in the capacity of ink droplets can be repressed suitably. As a result, printing can be performed more suitably with higher accuracy.

The above has described one example of the preferred constitution of the ink jet head 12. However, the concrete constitution of the ink jet head 12 is not limited to the above constitution, and various modifications can be made. Therefore, a modified example of the constitution of the ink jet head 12 is described below.

Figure 6A:
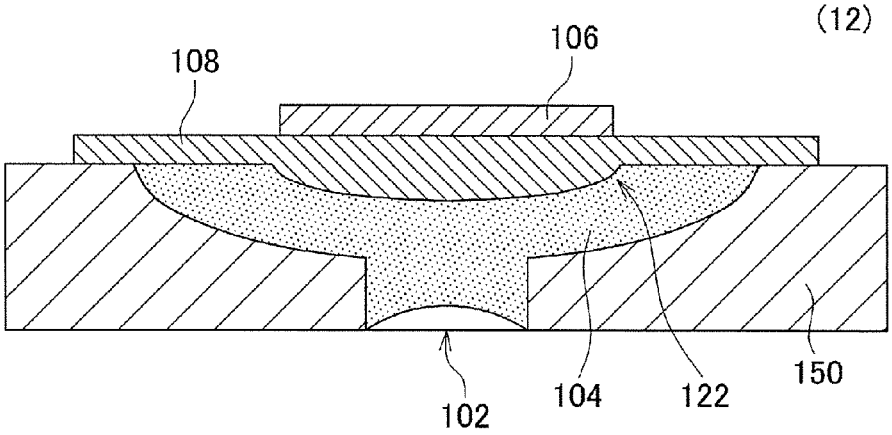
FIGS. 6A and 6B illustrate one example of a constitution around the nozzle 102 in a modified example of the constitution of the ink jet head 12.
Figure 6B:
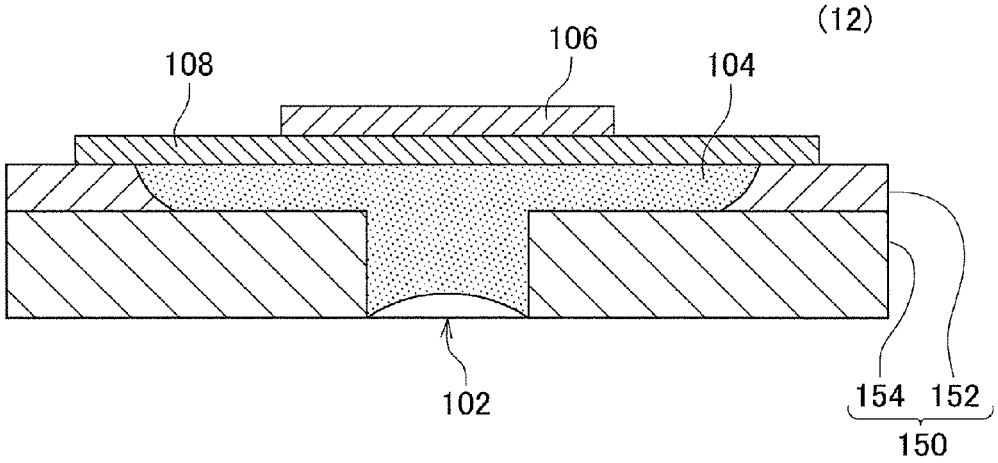

FIGS. 6A and 6B illustrate one example of the constitution around the nozzle 102 in a modified example of the constitution of the ink jet head 12. The components of the constitution in FIGS. 6A and 6B that are denoted by the same reference numerals as those in FIGS. 1 to 5 have characteristics that are the same as or similar to those of the constitution in FIGS. 1 to 5 except for the following description.

FIG. 6A illustrates a first modified example of the constitution of the ink jet head 12. As described above, it is preferable that when ink droplets are discharged, all the ink in the ink chamber 104 is discharged from the nozzle 102. In order to achieve such a constitution, it is preferable that the thin film 108 is stuck on the bottom surface of the ink chamber 104 as firmly as possible at the time of discharge.

It is considered that the thin film 108 having a convex section 122 as shown in FIG. 6A concretely is used as a constitution where the thin film 108 is easily stuck on the bottom surface of the ink chamber 104. In this case, the convex section 122 is a convex portion having a shape according to the shape of the bottom surface of the ink chamber 104, and is provided on the surface of the thin film 108 opposed to the nozzle 102. Such a constitution enables the thin film 108 to be firmly stuck on the bottom surface of the ink chamber 104 more suitably at the time of discharging ink droplets.

FIG. 6B illustrates a second modified example of the constitution of the ink jet head 12. As to the shape of the bottom surface of the ink chamber 104, a portion that contacts with the thin film 108 may be flat. It is particularly preferable that a peripheral portion of the hole connected to the nozzle 102 in the portion contacting with the thin film 108 is flat. Such a constitution also enables the thin film 108 to be firmly stuck on the bottom surface of the ink chamber 104 more suitably at the time of discharging ink droplets.

Further, the nozzle plate 150 may be formed by a plurality of members in the ink jet head 12. In the constitution shown in FIG. 6B, the nozzle plate 150 is composed of a first member 152 and a second member 154 that form the plurality of members. The first member 152 and the second member 154 are stuck in an overlapping manner so as to be a plate-shaped member composing the nozzle plate 150. Each of the first member 152 and the second member 154 is formed with holes and cavities related to the plurality of nozzles 102 and the plurality of ink chambers 104 in the ink jet head 12.

In such a constitution, a part of the upper surface of the second member 154 is used as a part of the bottom surface of the ink chamber 104 so that the depth of the ink chamber 104 can be set suitably with high accuracy as shown in FIG. 6B. As a result, the inner volume of the ink chamber 104 can be set suitably with high accuracy. Further, the bottom surface of the ink chamber 104 is easily made to be flat. For this reason, such a constitution enables the ink chamber 104 having a desired shape to be formed more suitably. As a result, the capacity of ink droplets can be controlled suitably with higher accuracy.

The part of the concrete constitution of the ink jet head 12 other than the modified example can be used. For example, as to the provision of the piezoelectric element 106 onto the thin film 108, the piezoelectric element 106 is not directly disposed on the thin film 108, and another member may be provided between the thin film 108 and the piezoelectric element 106. An elastic member may be disposed between the thin film 108 and the piezoelectric element 106 if necessary. Such a constitution enables the curve of the piezoelectric element 106 to be adjusted more suitably.

The above has described the embodiment of the present disclosure, but the technical scope of the present disclosure is not limited to the scope described in the embodiment. The person skilled in the art understands that the embodiment can be variously modified and improved. It is clarified by description in What Is Claimed Is that the modified or improved mode is included in the technical scope of the present disclosure.

The present disclosure can be suitably used in print devices.

What is claimed is:

1. A print device for printing using an ink jet method, comprising:

an ink jet head for discharging ink droplets;

a drive signal output section for outputting a drive signal for allowing the ink jet head to discharge ink droplets;

an ink storage section for storing ink to be supplied to the ink chamber; and an ink supply route for supplying the ink from the ink storage section to the ink chamber, wherein the ink jet head includes:

a nozzle plate;

a nozzle for discharging ink droplets, and formed on a first surface of the nozzle plate;

an ink chamber for storing ink to be supplied to the nozzle at a former stage of the nozzle, and formed on a second surface of the nozzle plate opposite to the first surface, the ink chamber having a hole connected to the nozzle and an opening on a position different from the hole;

an opening section thin film that is a thin film for covering the opening of the ink chamber; and a piezoelectric element that is displaced according to the drive signal so as to apply pressure to the ink chamber, and the piezoelectric element is disposed on the opening section thin film with a main surface of the piezoelectric element along the opening section thin film, wherein the piezoelectric element is curved with a center toward the nozzle according to a change in the drive signal, and applies pressure to the ink chamber via the opening section thin film, and ink droplets are discharged from the nozzle according to the pressure applied to the ink chamber by the piezoelectric element.

2. The print device according to claim 1, wherein the piezoelectric element has an electrode that receives the drive signal on one end and the other end in a direction along a surface of the opening section thin film.

3. The print device according to claim 1, wherein when an inner volume of the ink chamber is set to V0 and a capacity of ink droplets discharged once from the nozzle is set to V1, V1/V0 is 0.5 or more.

4. The print device according to claim 1, wherein the piezoelectric element is displaced into a shape along the second surface formed with the hole connected to the nozzle in the ink chamber, so that the ink droplets are discharge from the nozzle.

5. The print device according to claim 1, wherein when the ink droplets are discharged from the nozzle, the piezoelectric element is displaced so that at least a part of the opening section thin film contacts with at least a part of the second surface in the ink chamber.

6. The print device according to claim 1, wherein after performing a first displacement for curving the center toward the direction opposite to the nozzle according to the change in the drive signal, the piezoelectric element performs a second displacement for curving the center toward the direction of the nozzle, ink is supplied from the ink storage section via the ink supply route to the ink chamber according to the first displacement of the piezoelectric element, and the ink droplets are discharged from the nozzle according to the second displacement of the piezoelectric element.

7. The print device according to claim 6, wherein the print device changes the capacity of the ink droplets to be discharged from the nozzle at a plurality of stages so as to perfonn multi-gradation printing, and the drive signal output section is capable of outputting plural kinds of the drive signals for making displacement magnitude in the first displacement vary, and selects the drive signal to be supplied to the piezoelectric element for discharging ink droplets to the nozzle according to the capacity of the ink droplets to be discharged from the nozzle.

* * * * *